US010105016B2

(12) United States Patent
Qian et al.

(10) Patent No.: US 10,105,016 B2
(45) Date of Patent: Oct. 23, 2018

(54) PORTABLE WATER AND ENERGY SAVING BATHTUB

(71) Applicants: Davy Zide Qian, Arcadia, CA (US); Benyu Qian, Shanghai (CN); Lequn Lu, Shanghai (CN)

(72) Inventors: Davy Zide Qian, Arcadia, CA (US); Benyu Qian, Shanghai (CN); Lequn Lu, Shanghai (CN)

( * ) Notice: Subject to any disclaimer, the term of this patent is extended or adjusted under 35 U.S.C. 154(b) by 888 days.

(21) Appl. No.: 13/779,026

(22) Filed: Feb. 27, 2013

(65) Prior Publication Data

US 2013/0263371 A1 Oct. 10, 2013

Related U.S. Application Data

(60) Provisional application No. 61/605,190, filed on Mar. 1, 2012.

(51) Int. Cl.
*A47K 3/02* (2006.01)
*A47K 3/14* (2006.01)

(52) U.S. Cl.
CPC . *A47K 3/02* (2013.01); *A47K 3/14* (2013.01)

(58) Field of Classification Search
USPC ..... 4/555, 556, 539, 559, 554
See application file for complete search history.

(56) References Cited

U.S. PATENT DOCUMENTS 906,992 A * 12/1908 Bailey ..... 4/554
6,381,769 B1 * 5/2002 Lofquist, Jr. ..... 4/555

* cited by examiner

*Primary Examiner* — Lauren Crane
(74) *Attorney, Agent, or Firm* — Global IP Services; Tianhua Gu

(57) ABSTRACT

A portable water and energy saving bathtub used in a shower room or a bathtub comprises a body liking an opened container, a step on the bottom is located beside the end wall. The other end is a flashboard gate, which includes a groove on inner faces of the container, the flashboard capable of moving is inserted into the groove until to a bottom of the groove, a water seal ring is set between the groove and the flashboard. A reducing-volume-chunk likes a cuboid has two legs sitting on the side walls of container, therefore, the reducing-volume-chunk is hanged in the container. A locking-releasing-device locks or releases the rock for the reducing-volume-chunk with the container.

11 Claims, 3 Drawing Sheets

PORTABLE WATER AND ENERGY SAVING BATHTUB

CROSS REFERENCE TO RELATED PATENT APPLICATIONS

This patent application claims the domestic priority of US provisional applications No. 61605190 filed on Mar. 1, 2012, which application is incorporated herein by reference.

FIELD OF INVENTION

This invention belongs to a field of bath device. More specifically, this invention relates to a portable water and energy saving bathtub.

BACKGROUND OF THE INVENTION

Many families have shower rooms, but do not have a bathtub. Therefore, family members cannot enjoy the benefit of a hot bath, such as releasing tiredness, improving blood circulation, easing back and muscle pain, etc. Many families have a bathtub, but they still cannot enjoy the benefit of a hot bath. This is caused by needing large amount hot water to fill up the bathtub. It wastes water and energy and it is not satisfied the principle of environment protection.

The purpose of present invention is to provide people a water and energy saving portable bathtub. Which can be easily used in a small shower room or in a bathtub with reasonable hot water for a hot bath. Thus, when people want to takes a hot bath, they still can save water and energy. After finishing the hot bath, the used water in the water and energy saving portable bathtub can be easily emptied or drained, and the bathtub can be moved to a storage easily. Since it is easy to carry and can save water and energy, the water and energy saving portable bathtub also can be used for outdoor bath. The water and energy saving portable bathtub of the present invention provides people a saving and convenient way for taking a hot bath with a reasonable amount hot water. Which is benefit in water saving and environment protection.

SUMMARY OF THE INVENTION

The purpose of this invention is realized by the following conceptions:

A portable water and energy saving bathtub used in a shower room or a bathtub comprises a body defined by a first and a second side walls, a first and a second end walls and a bottom to become an opened container, a step on the bottom is located beside the second end wall. The first end wall is a flashboard gate, which includes a groove on inner faces of the container, the flashboard capable of moving is inserted into the groove until to a bottom of the groove, a water seal ring is set between the groove and the flashboard. A reducing-volume-chunk likes a cuboid, a wide of the cuboid is smaller than the same of the container and a height of the cuboid is smaller than the distance between the legs of a bath person sitting on the step and the top of the container; the top of the reducing-volume-chunk extend to outside to form two hanging arms with a groove respectively. The two grooves sit on the first and second side walls, therefore, the reducing-volume-chunk is hanged in the container. A locking-releasing-device, which can lock the reducing-volume-chunk with the container together or release the lock to separate the reducing-volume-chunk from the container.

As another embodiment the portable water and energy saving bathtub has no step in the container and has no the reducing-volume-chunk and the locking-releasing-device. A bath person can stand inside to take a bath.

After a bath person enters the water and energy saving bathtub from the flashboard gate, he closes the flashboard gate by inserting the flashboard into the grove and pushing the flashboard into the grove bottom. Then sits on the step and puts the two arms of the reducing-volume-chunk on the tops of first and second side walls of the container and locks the reducing-volume-chunk with the container together by the locking-releasing-device. Pours hot water into the container until the water level to the bath person's shoulder. Thereafter, the person can enjoy a hot both. After finishing the hot bath, the bath person pulls up the flashboard to let the hot water out, then releases the locking-releasing-device, take the reducing-volume-chunk off, the person can go out from the flashboard gate.

The volume of the container is much smaller than a common bathtub. The water needed for the hot bath is that the volume of the container deducts the volume of the reducing-volume-chunk. Therefore, large amount of hot water is saved for a hot bath.

DETAIL DESCRIPTION OF THE INVENTION

Figure 1:
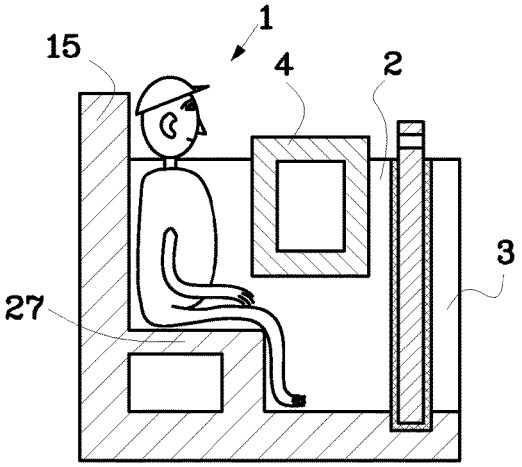
FIG. 1 is a cross section view of a portable water and energy saving bathtub of present invention.
Figure 2:
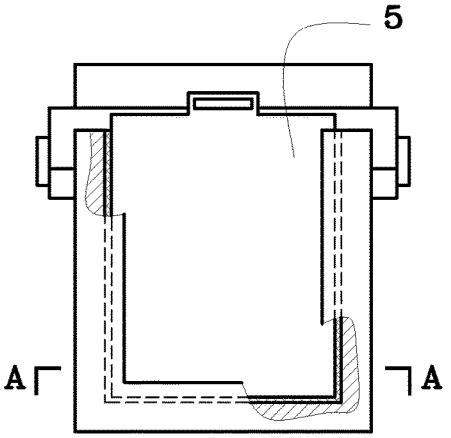
FIG. 2 is a right side view of the portable water and energy saving bathtub shown in the FIG. 1, several place takes a partial cross section views.
Figure 3:
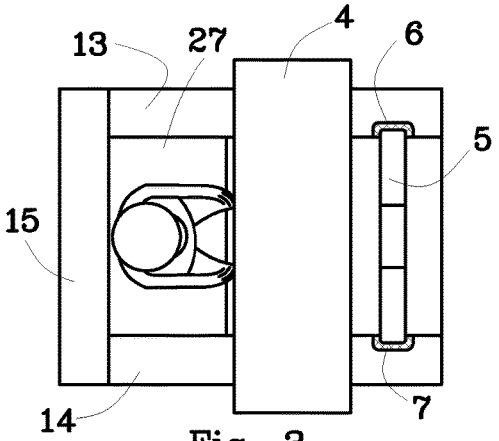
FIG. 3 is a top view of the portable water and energy saving bathtub shown in the FIG. 1.

Please refer to the FIGS. 1, 2, 3 and 4, a portable water and energy saving bathtub (1) of present invention, which can be used in a shower room or bathtub.

The portable water and energy saving bathtub (1) comprises a body (2), a flashboard gate (3), a reducing-volume-chunk (4) and a locking-releasing-device 16.

Figure 7:
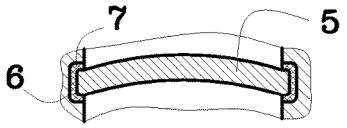
FIG. 7 is a cross section view along A-A shown in FIG. 2.
Figure 8:
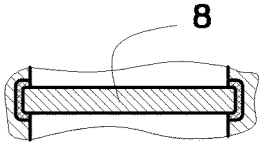
FIG. 8 is a cross section view along A-A shown in FIG. 2, showing another embodiment of the flashboard.
Figure 4:
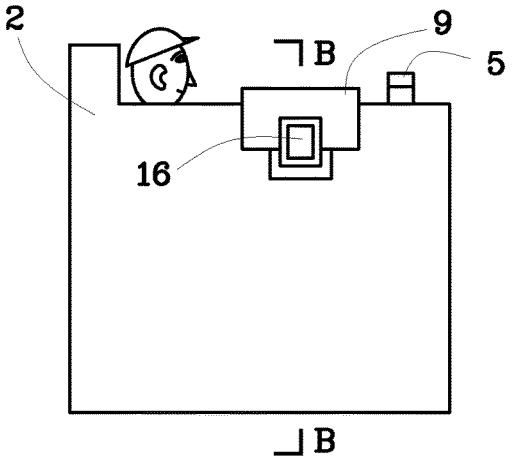
FIG. 4 is a front view of the portable water and energy saving bathtub shown in the FIG. 1.

The body (1) is defined by a first and a second side walls (13, 14), a first and a second end walls (3, 15) as well as a bottom to become an opened container (2). The second end wall (15) has a step (27) on the bottom for a bathing person setting down on it. The first end wall (3) is a flashboard gate (3), which includes a groove (6) on inner faces of the container (2) and a flashboard (5). The flashboard (5) is capable of moving and is inserted into the groove (6). A water seal ring (7) is set between the groove (6) and the flashboard (5). The flashboard (5) can be inserted into the bottom of the groove (6) or pulled out from the groove (6). The flashboard gate (3) is rectangular having a rectangular groove (6) and a rectangular flashboard (5). Refer to FIG. 8 the flashboard (5) is flat. Refer to FIG. 7, the cross section of the flashboard (5) is bulgy to the inside of the container (2). The water seal ring (7) is made from rubber or plastic material.

Figure 5:
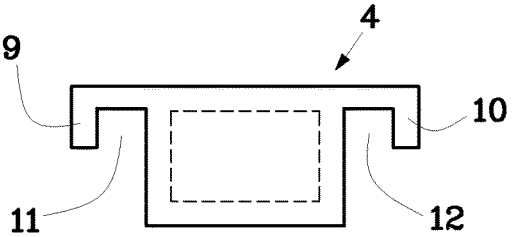
FIG. 5 is a front view of the reducing-volume-chunk.
Figure 6:
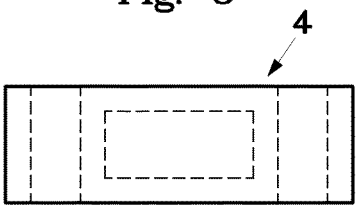
FIG. 6 is a top view of the reducing-volume-chunk.

Refer to FIGS. 1, 4, 5 and 6 a reducing-volume-chunk (4) has a cuboid shape, its wide is smaller than the same of the container (2) and its height is smaller than the distance between the legs of a bathing person sitting on the step (27) of the container (2) and the top of the container (2). Refer to FIGS. 5 and 6 the top of the reducing-volume-chunk (4) extends to outside to form two hanging arms (9, 10), which have a groove (11 or 12) respectively. The two grooves (11, 12) sit on the first and second side walls (13, 14) of the container (2), therefore, the reducing-volume-chunk (4) is hanged in the inside of the container (2) to reduce the capacity of the container (2). The reducing-volume-chunk (4) can be made from wood or plastic, inside of it can be empty (see FIGS. 1, 5 and 6).

Refer to FIGS. 4, 9, 13, 14, 15 and 16, a locking-releasing-device (16) for locking the reducing-volume-chunk (4) together with the container (2) or release the lock to separate the reducing-volume-chunk (4) from the container (2). The locking-releasing-device (16) has a first part (19*a*, 21*a*, 22*a*) fixed on a side of the reducing-volume-chunk (4), a second part (19*b*, 21*b*, 22*b*) fixed on a side of the container (2). When put the first and second parts together to lock, the reducing-volume-chunk (4) is locked with the container (2); when take the first part off from the second part, the reducing-volume-chunk (4) is separated from the container (2). The locking-releasing-device (4) can use the spring latch (18) for travelling case or the hasp (22*a*, 22*b*) for door and window or the hook (19*a*, 19*b*) or the scotch fasteners (21*a*, 21*b*).

Figure 9:
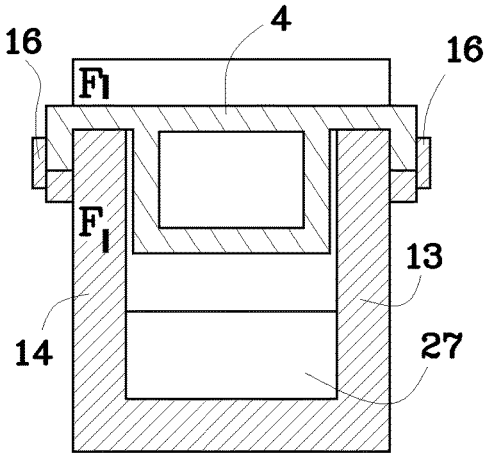
FIG. 9 is a cross section view along B-B shown in FIG. 4.
Figure 10:
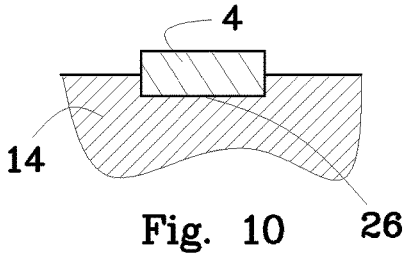
FIG. 10 is an enlarged partial cross section view of the area shown by F-F in FIG. 9.
Figure 13:
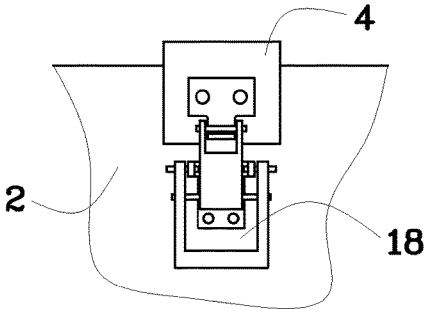
FIG. 13 is a enlarge view of the locking-releasing-device 16 shown in FIG. 4, which is a spring latch for travelling case.

Please refer to FIGS. 9 and 10, a groove 26 is on the tops of the first and second side wall (13, 14). The wide of the groove (26) is little wider than the wide of locking-releasing-device (4) for receive it. Therefore, the locking-releasing-device (4) can be easily fixed at the correct position.

Figure 17:
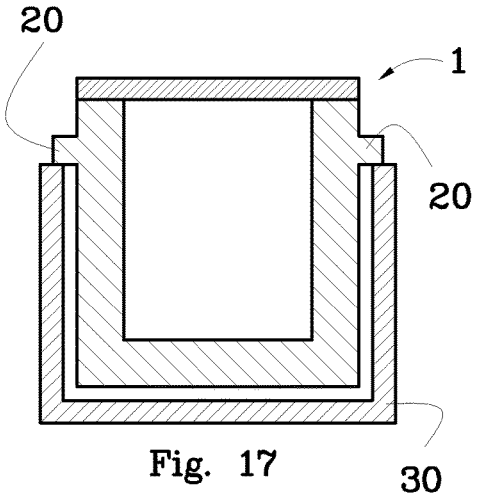
FIG. 17 is a diagram, shows the portable water and energy saving bathtub being in a common bathtub.

Please refer to FIG. 17, the container (2) has a protuberant shoulder (20) on the first and second side walls (13, 14) respectively. The portable water and energy saving bathtub (1) can be put in a common bathtub (30), the two protuberant shoulders (20) are on the two side walls of the common bathtub (30).

Figure 18:
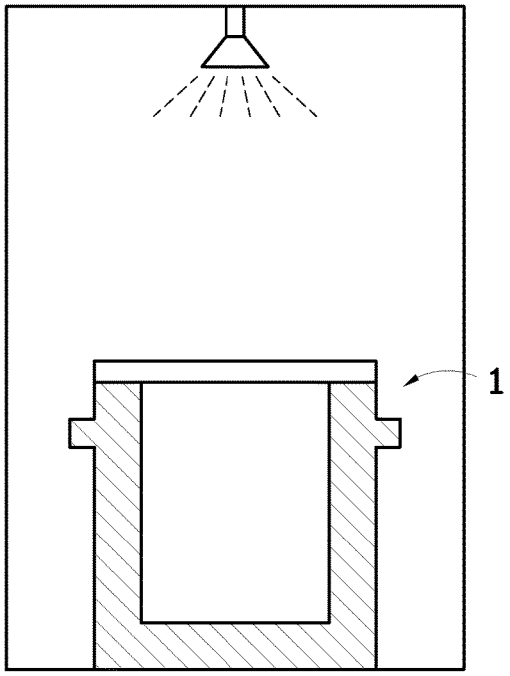
FIG. 18 is a diagram, shows the portable water and energy saving bathtub being in a shower room.

Please refer to FIG. 18, the portable water and energy saving bathtub (1) can be used in a shower room. Just put it under the shower.

After a bath person enters the water and energy saving bathtub (1) from the flashboard gate (3), he closes the flashboard gate (3) by inserting the flashboard (5) into the grove (6) and pushing the flashboard (5) into the grove (6) bottom. Then sits on the step (27) and puts the two arms of the reducing-volume-chunk on the tops of first and second side walls (13, 14) of the container (2) and locks the reducing-volume-chunk (4) with the container (2) together by the locking-releasing-device (16). Pours hot water into the container until the water level at the person's shoulder, the person can enjoy a hot both. After finishing the hot bath, the person pulls up the flashboard (5) to let the hot water out, then releases the locking-releasing-device (16), take the reducing-volume-chunk (4) off, the person can go out from the flashboard gate (3).

Figure 19:
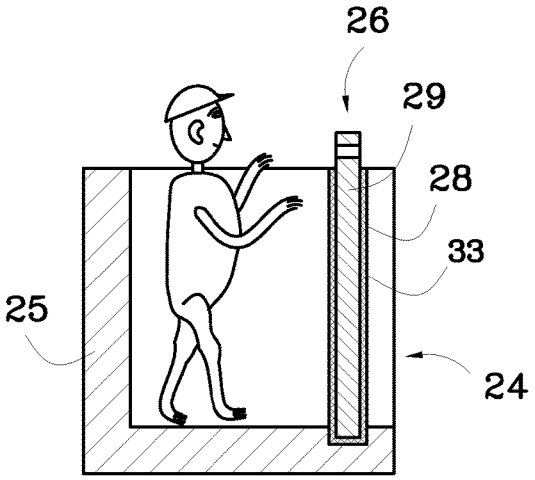
FIG. 19 is second embodiment of the portable water and energy saving bathtub.

Please refer to FIG. 19, it is another embodiment of the portable water and energy saving bathtub (24). The portable water and energy saving bathtub (24) comprises a container (25) and a flashboard gate (26). The container (25) is a cuboid shape having a height reaching to the shoulder of a standing bath person. The container (25) has first and second side walls and first and second end walls as well as a bottom, which define the container (25).

The first end wall is a flashboard gate (24), which includes a groove (28) on inner faces of the container (25) and a flashboard (29). The flashboard (29) is capable of moving and is inserted into the groove (28). A water seal ring (27) is set between the groove (28) and the flashboard (29). The flashboard (29) can be inserted into the bottom of the groove (28) or pulled out from the groove (28).

Figure 11:
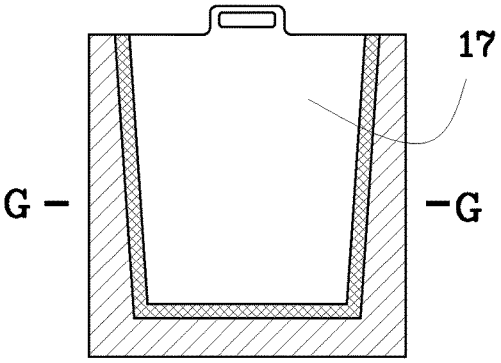
FIG. 11 is a front view of another embodiment of the flashboard gate.
Figure 14:
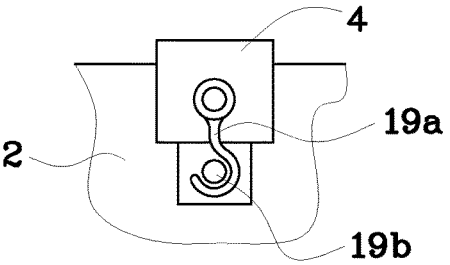
FIG. 14 is another embodiment of the locking-releasing-device, which is a hook.
Figure 12:
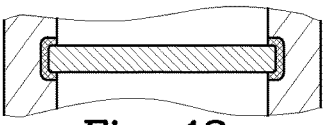
FIG. 12 is a cross section view of the flashboard gate shown in FIG. 11.
Figure 15:
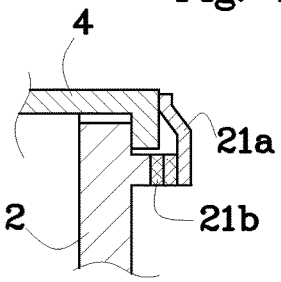
FIG. 15 is another embodiment of the locking-releasing-device, which is a pair of scotch fasteners.
Figure 16:
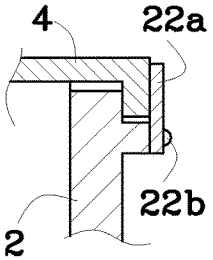
FIG. 16 is another embodiment of the locking-releasing-device, which is a hasp for door and window.

The flashboard gate (26) can be of isosceles trapezoid, having a flashboard (29) of isosceles trapezoid and groove (28) of isosceles trapezoid (similar as the FIG. 11). As the flashboard (29) is of isosceles trapezoid the bath person can pull the flashboard (29) up a distance but not to the top of the groove (28), then take the flashboard out from the groove (28). The water seal ring is made from rubber or plastic material.

The flashboard gate (24) can be rectangular having rectangular groove (28) and rectangular flashboard (29). The flashboard (29) is flat. Also, the cross section of the flashboard (29) is bulgy to the inside of the container (25) (similar as the FIG. 7). The water seal ring (27) is made from rubber or plastic material.

After a bath person enters the water and energy saving bathtub (24) from the flashboard gate (26), he closes the flashboard gate (26) by inserting the flashboard (29) into the grove (28) and pushing the flashboard (29) into the grove (28) bottom. Pours hot water into the container (25) until the water level at the standing bath person's shoulder, the person can enjoy a hot both. After finishing the hot bath, the bath person pulls up the flashboard (29) to let the hot water out, then the person can go out from the flashboard gate (26).

What is claimed is:

1. A portable water and energy saving bathtub comprising:

a body, it is defined by a first and a second side walls, a first and a second end walls as well as a bottom to become an opened container without a water discharge hole, a step on the bottom is located beside the second end wall;

a flashboard gate, which is the first end wall, includes a groove on inner faces of the container, a flashboard capable of moving is inserted into the groove, a water seal ring is set between the groove and the flashboard, when the flashboard gate is closed the container holds water without, when the flashboard is opened water is discharged;

a reducing-volume-chunk for raising water level in the bathtub, liking a cube, a width of the cube is smaller than the same of the container, a height of the cube is smaller than a distance between legs of a bath person sitting on the step and a top of the container; the reducing-volume-chunk has two hanging arms extending to outside of the cube, each hanging arm has a groove, the grooves sit on the first and second side walls of the container, therefore, the reducing-volume-chunk is hanged in the container;

a locking-releasing-device for the reducing-volume-chunk, which can lock the reducing-volume-chunk together with the container or release the lock to separate the reducing-volume-chunk from the container.

2. The portable water and energy saving bathtub of claim 1, wherein the container is cube shape, the flashboard is rectangular.

3. The portable water and energy saving bathtub of claim 1, wherein the container is shaped as a cube, the flashboard is of an isosceles trapezoid.

4. The portable water and energy saving bathtub of claim 2, wherein a cross section of the rectangular flashboard protrudes to inside of the container.

5. The portable water and energy saving bathtub of claim 2, wherein the grove of the hanging arm of the reducing-volume-chunk is wider than a width of the first or second side wall of the container.

6. The portable water and energy saving bathtub of claim 1, wherein two grooves are on the tops of the first and second side walls, a width of the groove is wider than a width of the hanging arm of the reducing-volume-chunk, the hanging arm is easily put in the groove to fix a correct position of the locking-releasing-device.

7. The portable water and energy saving bathtub of claim 1, wherein the cube of the reducing-volume-chunk has an empty chamber inside of it for reducing weight.

8. The portable water and energy saving bathtub of claim 1, wherein the locking-releasing-device has a first part fixed on a side of the reducing-volume-chunk, a second part fixed on a side of the container, when put the first and second parts together, the reducing-volume-chunk is locked with the container; when take off the first part from the second part, the reducing-volume-chunk is separated from the container.

9. The portable water and energy saving bathtub of claim 8, wherein the locking-releasing-device is a spring latch for travelling case or a hasp for door and window or a hook.

10. The portable water and energy saving bathtub of claim 1, wherein the first and second side walls of the container have convex shoulder respectively, when put the portable water and energy saving bathtub in a bathtub the convex shoulders sit on side walls of the bathtub.

11. The portable water and energy saving bathtub of claim 1, wherein the portable water and energy saving bathtub is put in a shower room under a shower head.

* * * * *